US010745247B2

(12) United States Patent
Witczak et al.

(10) Patent No.: US 10,745,247 B2
(45) Date of Patent: Aug. 18, 2020

(54) ELEVATOR CAR GUIDANCE MECHANISM

(71) Applicant: OTIS ELEVATOR COMPANY, Farmington, CT (US)

(72) Inventors: Tadeusz Pawel Witczak, Bethel, CT (US); Richard N. Fargo, Plainville, CT (US); Enrico Manes, Feeding Hills, MA (US); Zbigniew Piech, Cheshire, CT (US); Bruce P. Swaybill, Farmington, CT (US); Richard J. Ericson, Southington, CT (US); Xiaodong Luo, South Windsor, CT (US); Adam Marian Myszkowski, Ostrow Wlkp (PL)

(73) Assignee: OTIS ELEVATOR COMPANY, Farmington, CT (US)

( * ) Notice: Subject to any disclaimer, the term of this patent is extended or adjusted under 35 U.S.C. 154(b) by 791 days.

(21) Appl. No.: 15/247,314

(22) Filed: Aug. 25, 2016

(65) Prior Publication Data

US 2017/0057786 A1 Mar. 2, 2017

Related U.S. Application Data

(60) Provisional application No. 62/209,765, filed on Aug. 25, 2015.

(51) Int. Cl.
*B66B 7/04* (2006.01)
*B66B 7/02* (2006.01)
(Continued)

(52) U.S. Cl.
CPC ..... *B66B 7/046* (2013.01); *B66B 7/022* (2013.01); *B66B 7/047* (2013.01); *B66B 9/003* (2013.01); *B66B 11/0407* (2013.01)

(58) Field of Classification Search
CPC ..... B66B 11/0407; B66B 7/046; B66B 7/047; B66B 7/022; B66B 9/003
See application file for complete search history.

(56) References Cited

U.S. PATENT DOCUMENTS 4,047,597 A 9/1977 Okura et al.
5,984,053 A 11/1999 Lee et al.
(Continued)

FOREIGN PATENT DOCUMENTS

CN 2255421 Y 6/1997
CN 158819 A 9/1997
(Continued)

OTHER PUBLICATIONS

Office Action for Chinese Application No. 201610720953.4 dated Mar. 20, 2019; 33 pages.

*Primary Examiner* — Diem M Tran
(74) *Attorney, Agent, or Firm* — Cantor Colburn LLP

(57) ABSTRACT

A guidance mechanism for an elevator car is constructed and arranged to move along a lane defined at least in-part between two opposing first and second lane structures of a stationary structure. The guidance mechanism includes a first support structure supported by the first lane structure. The first support structure includes a first retainer face disposed between the elevator car and the first lane structure that substantially faces the first lane structure, and is spaced from the first lane structure. A first retention device of the mechanism is disposed, at least in part, between the first retainer face and the first lane structure. The first retention device is supported by the elevator car and is constructed and arranged to contact the first retainer face for limiting lateral movement of the elevator car away from the first lane structure and toward the second lane structure.

7 Claims, 6 Drawing Sheets

(51) Int. Cl.
*B66B 11/04* (2006.01)
*B66B 9/00* (2006.01)

(56) References Cited

U.S. PATENT DOCUMENTS 8,427,004 B2 5/2013 Kitanaka
9,487,377 B2 * 11/2016 Loeser ..... B66B 11/0407

FOREIGN PATENT DOCUMENTS

| | | | | | |
|---|---|---|---|---|---|
| CN | 201574010 | U | | 9/2010 | |
| CN | 102020154 | A | | 4/2011 | |
| CN | 102826421 | A | | 12/2012 | |
| CN | 103097273 | A | | 5/2013 | |
| JP | 06271241 | A | * | 9/1994 | ..... B66B 7/022 |
| JP | H08217361 | A | | 8/1996 | |
| JP | H09202558 | A | | 8/1997 | |
| JP | 2005225668 | A | | 8/2005 | |
| JP | 2006151645 | A | | 6/2006 | |
| JP | 2008230840 | A | | 10/2008 | |
| SU | 961172 | A1 | | 12/1982 | |
| WO | 2015084364 | A1 | | 6/2015 | |

* cited by examiner

ELEVATOR CAR GUIDANCE MECHANISM

CROSS REFERENCE TO RELATED APPLICATION

This application claims priority to U.S. Provisional Patent Application No. 62/209,765, filed Aug. 25, 2015, the entire contents of which is incorporated herein by reference.

BACKGROUND

The present disclosure relates to elevator systems, and more particularly to guidance mechanisms for an elevator car of the elevator system.

Self-propelled elevator systems, also referred to as ropeless elevator systems, are useful in certain applications (e.g., high rise buildings) where the mass of the ropes for a roped system is prohibitive and there is a desire for multiple elevator cars to travel in a lane. Similar to roped elevator cars, ropeless elevator cars may be guided by rails secured to and extending along the lane. However, unlike roped elevator cars, ropeless elevator cars may not have the additional safety assurances provided by a suspended cable in the case of elevator car derailment. Improvements in rail guidance and retention mechanisms of elevator systems is desirable.

SUMMARY

A guidance mechanism for an elevator car constructed and arranged to move along a lane defined at least in-part between two opposing first and second lane structures of a stationary structure, the guidance mechanism according to one, non-limiting, embodiment of the present disclosure includes a first support structure supported by the first lane structure, the first support structure including a first retainer face disposed between the elevator car and the first lane structure, that substantially faces and is spaced from the first lane structure; and a first retention device disposed at least in part between the first retainer face and the first lane structure, supported by the elevator car, and constructed and arranged to contact the first retainer face for limiting lateral movement of the elevator car away from the first lane structure and toward the second lane structure.

Additionally to the foregoing embodiment, a second support structure supported by the second lane structure, the second support structure including a retainer face disposed between the elevator car and the second lane structure, that substantially faces and is spaced from the second lane structure; and a second retention device disposed at least in part between the retainer face of the second support structure and the second lane structure, supported by the elevator car, and constructed and arranged to contact the retainer face of the second support structure for limiting lateral movement of the elevator car away from the second lane structure and toward the first lane structure.

In the alternative or additionally thereto, in the foregoing embodiment, the first retention device is a roller constructed and arranged to roll along the first retainer face.

In the alternative or additionally thereto, in the foregoing embodiment, the first retention device is a slider constructed and arranged to move along the first retainer face.

In the alternative or additionally thereto, in the foregoing embodiment, the first retention device is spaced from the first retainer face during normal elevator car operation.

In the alternative or additionally thereto, in the foregoing embodiment, the guidance mechanism includes a first roller supported by the elevator car and constructed and arranged to roll upon a first guidance face of the first support structure, wherein the first guidance face faces substantially opposite the first retainer face.

In the alternative or additionally thereto, in the foregoing embodiment, the guidance mechanism includes a second roller supported by the elevator car and constructed and arranged to roll upon a second guidance face of the first support structure, wherein the second guidance face is disposed substantially normal to the first guidance face and the first retainer face.

In the alternative or additionally thereto, in the foregoing embodiment, the guidance mechanism includes a third roller supported by the elevator car and constructed and arranged to roll upon a third guidance face of the first support structure, wherein the third guidance face faces opposite the second guidance face.

In the alternative or additionally thereto, in the foregoing embodiment, the first support structure includes a rail bracket constructed and arranged to support at least a part of a first portion of a linear propulsion motor for propelling the elevator car.

In the alternative or additionally thereto, in the foregoing embodiment, the guidance mechanism includes a second retainer face carried by a second projecting member of the first support structure disposed between the elevator car and the first lane structure, that substantially faces the first lane structure, and is spaced from the first lane structure, and wherein the first retainer face is carried by a first projecting member of the first support structure that projects in an opposite direction from the second projecting member; and a second retention device disposed at least in part between the second retainer face and the first lane structure, supported by the elevator car, and constructed and arranged to contact the second retainer face for limiting lateral movement of the elevator car away from the first lane structure and toward the second lane structure.

In the alternative or additionally thereto, in the foregoing embodiment, the guidance mechanism includes a fourth roller supported by the elevator car and constructed and arranged to roll upon a fourth guidance face carried by the second projecting element and that faces opposite the second retainer face.

In the alternative or additionally thereto, in the foregoing embodiment, the first and second guidance faces are carried by the first projecting member and the third guidance face is carried by the second projecting member.

In the alternative or additionally thereto, in the foregoing embodiment, the guidance mechanism includes a second retainer face carried by a second projecting member of the first support structure disposed between the elevator car and the first lane structure, that substantially faces the first lane structure, and is spaced from the first lane structure, and wherein the first retainer face is carried by a first projecting member of the first support structure that projects in an opposite direction from the second projecting member; and a second retention device disposed at least in part between the second retainer face and the first lane structure, supported by the elevator car, and constructed and arranged to contact the second retainer face for limiting lateral movement of the elevator car away from the first lane structure and toward the second lane structure.

In the alternative or additionally thereto, in the foregoing embodiment, the support structure is generally cross-shaped.

In the alternative or additionally thereto, in the foregoing embodiment, the guidance mechanism includes a first support structure supported by the first lane structure, the first support structure including a first retainer face disposed between the elevator car and the first lane structure, that substantially faces and is spaced from the first lane structure; and a third retention device disposed at least in part between the first retainer face and the first lane structure, supported by the elevator car, and spaced vertically from the first retention device.

In the alternative or additionally thereto, in the foregoing embodiment, the guidance mechanism includes a fifth roller supported by the elevator car and constructed and arranged to roll upon the first guidance face of the first support structure, wherein the first guidance face faces substantially opposite the first retainer face and the fifth roller is spaced vertically from the first roller.

A guidance mechanism for an elevator car constructed and arranged to move along a lane defined at least in-part by a lane structure of a stationary structure, the guidance mechanism in accordance with another, non-limiting, embodiment includes a support structure supported by the lane structure and including a first face facing at least in-part toward the lane structure, and a second face facing away from the first face and away from the lane structure; a first roller supported by the elevator car and constructed and arranged to roll at least upon the first face as the elevator car moves along the lane; and a second roller supported by the elevator car and constructed and arranged to roll at least upon the second face as the elevator car moves along the lane.

Additionally to the foregoing embodiment, the guidance mechanism includes a third roller supported by the elevator car and constructed and arranged to roll at least upon a third face of the support structure, and wherein the third face faces at least in-part toward the lane structure and away from the first and second faces.

In the alternative or additionally thereto, in the foregoing embodiment, the support structure includes an enlarged head and a stanchion extending between the lane structure and the enlarged head, and wherein the enlarged head carries the first, second and third faces.

In the alternative or additionally thereto, in the foregoing embodiment, the enlarged head is circular in cross section.

In the alternative or additionally thereto, in the foregoing embodiment, the enlarged head is triangular in cross section.

In the alternative or additionally thereto, in the foregoing embodiment, the enlarged head is parallelogram in cross section.

In the alternative or additionally thereto, in the foregoing embodiment, the guidance mechanism is a ropeless elevator guidance mechanism.

The foregoing features and elements may be combined in various combinations without exclusivity, unless expressly indicated otherwise. These features and elements as well as the operation thereof will become more apparent in light of the following description and the accompanying drawings. However, it should be understood that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
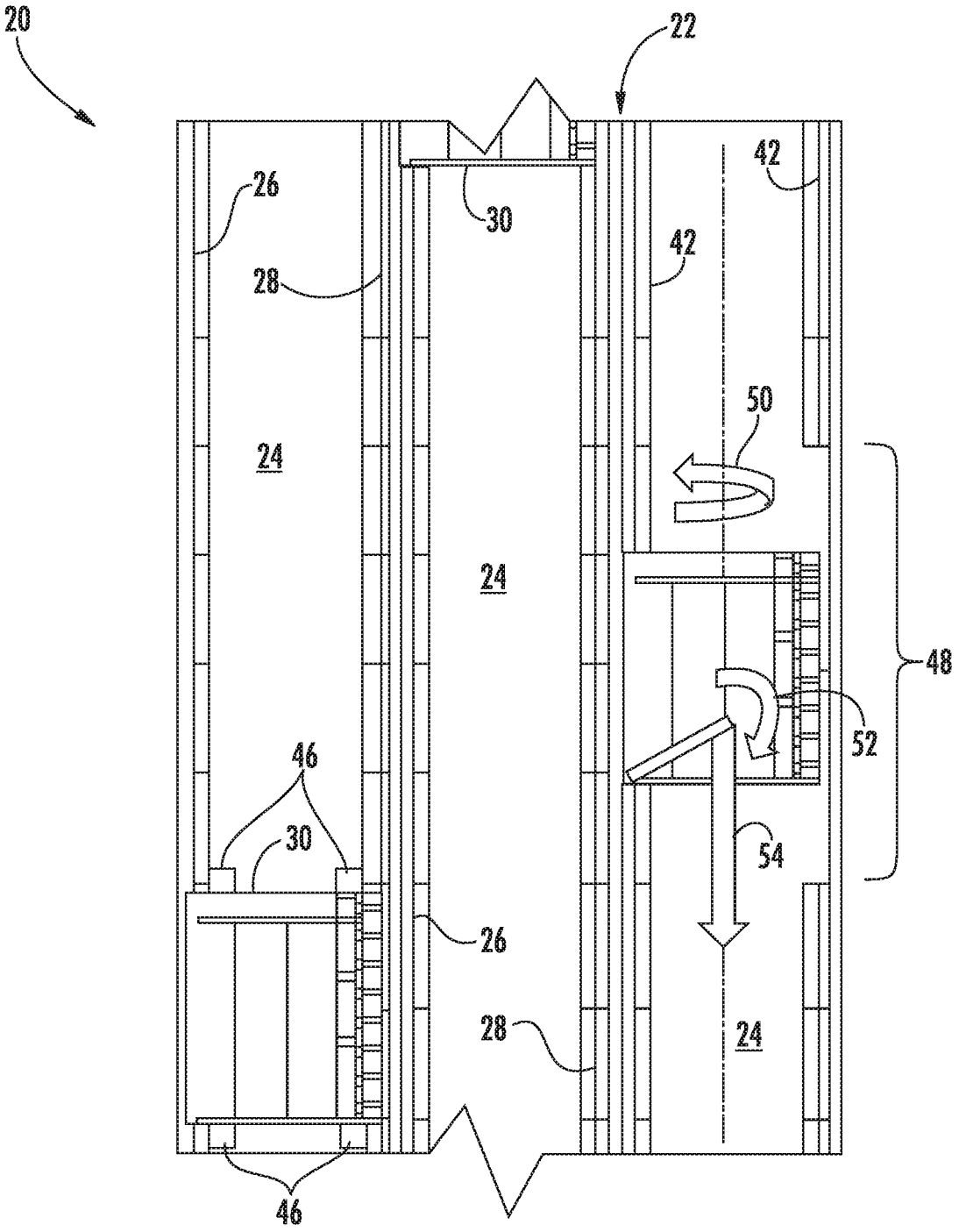
FIG. 1 is a side view of a multicar elevator system as one, non-limiting, exemplary embodiment of the present disclosure.

Referring to FIG. 1, an elevator system 20 as one exemplary embodiment may be ropeless and may be constructed in a multi-story building or occupiable structure 22. The elevator system 20 may include at least one lane 24 (i.e., three illustrated) defined by boundaries generally carried by at least two opposing lane structures 26, 28 of the occupiable structure 22 (e.g., walls). The system 20 further includes at least one car 30 that travels within the lane(s) 24. The car 30 may travel in a vertical direction, and may further travel in a dedicated upward direction in one lane 24 and a dedicated downward direction in another lane (as one, non-limiting, example). It is further contemplated and understood that the elevator system 20 may be self-propelled, and may have multiple cars 30 traveling in any one lane 24.

The elevator system 20 may further include upper and lower transfer stations (not shown) generally located at or above the top floor and at or below the bottom floor, respectively. Both stations may impart horizontal movement of the cars 30, thereby facilitating transfer of the cars between lanes 24. Although not shown in FIG. 1, one or more intermediate transfer stations, similar to the upper and lower transfer stations may be used between the first floor and the top floor.

Figure 2:
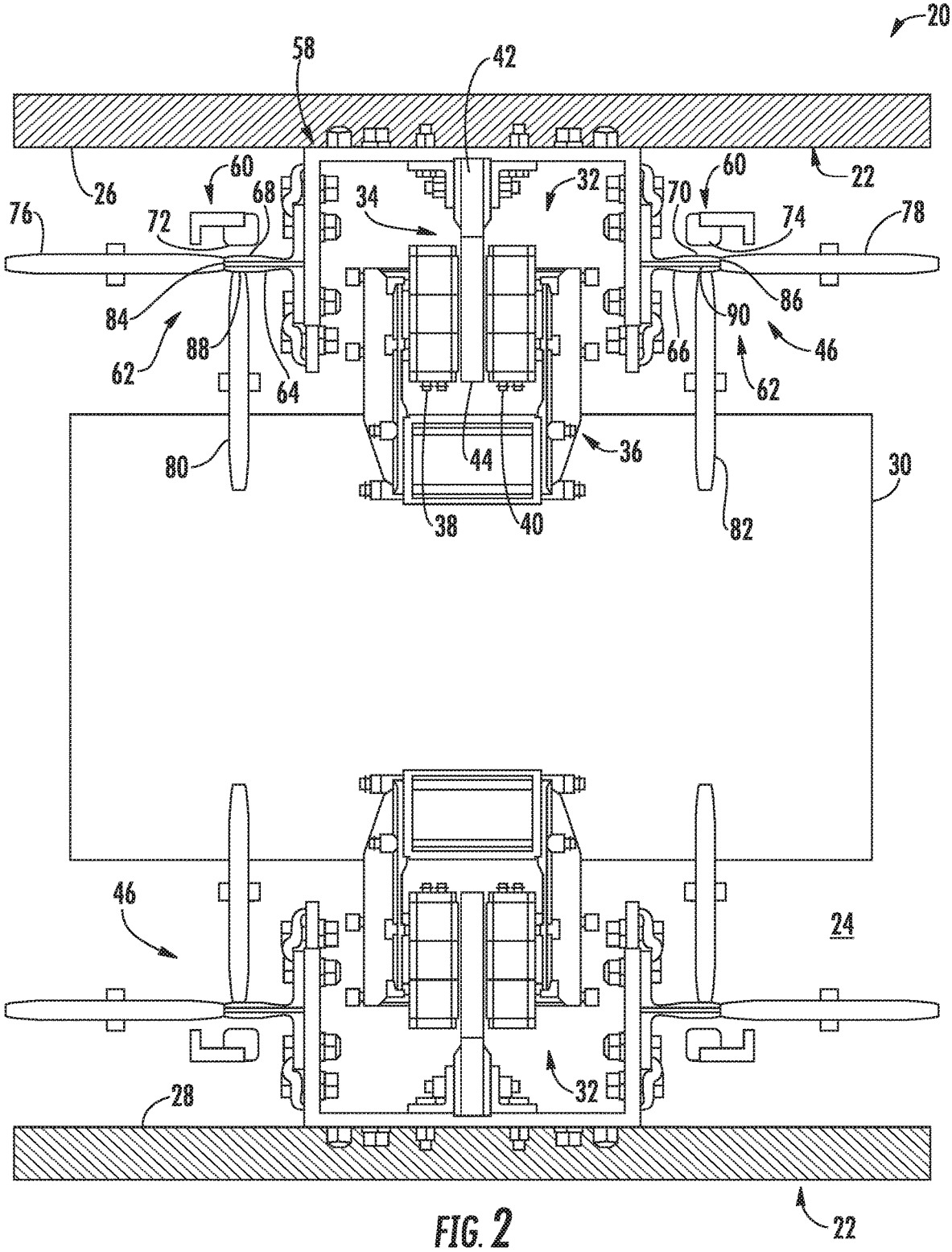
FIG. 2 is a top-down view of a guidance mechanism of the elevator system.

Referring to FIGS. 1 and 2, two linear propulsion motors 32 of the elevator system 20 are generally located between respective lane structures 26, 28 of the structure 22 and the elevator car 30. A magnetic field generated by each motor 32 generally propels the cars 30 within the lane 24. Each motor 32 may include a primary portion 34 that may be supported by the respective lane structures 26, 28, and a moving, secondary, portion 36 supported by the car 30. The secondary portion 36 of the linear propulsion motor 32, may include two rows or columns of permanent magnets 38, 40. The primary portion 34 may include a rail 42 engaged to the respective lane structures 26, 28 and a row of electric coils 44 supported by the rail 42 and located between and spaced laterally inward from the permanent magnets 38, 40. Both portions 34, 36 are elongated and extend longitudinally in the direction of car travel. It is further contemplated and understood that positioning of the portions 34, 36 may be interchanged with the primary portion 34 engaged to the car 30 and the secondary portion 36 engaged to the support structure 22. It is further understood that each elevator car 30 may be associated with any number of linear propulsion motors 32 including one; and, the permanent magnets 38, 40 may be one or more rows (i.e. two illustrated) for each propulsion motor 32. Moreover, the lane 24 may generally be located on the exterior of a structure 22 thus generally defined by only one exterior lane structure 24 with no opposing second lane structure.

The elevator system 20 may further include two guidance mechanisms 46 carried and located between the respective opposing lane structures 26, 28 and opposite sides of the car 30. Moreover, a pair of guidance mechanisms 46 may be mounted on each of the opposite respective sides of the car 30 with a vertical spacing located between each mechanism (see FIG. 1). For example, two mechanisms 46 may be located proximate to the top of the car 30, and another two located proximate to the bottom. The guidance mechanisms 46 are designed to work jointly such that if one rail 42 of a section of the primary portion 34 should fail (see area bracketed as region 48 in FIG. 1), the opposing guidance mechanisms 46 are capable of limiting elevator car twist (i.e., see arrow 50), elevator car overturning moment (i.e., see arrow 52), and general loss of vertical support (i.e., see arrow 54). Rail failure may also generally include elevator car derailment, linear propulsion motor 32 failure and others. It is further understood and contemplated that the elevator system 20 may include any number of guidance mechanisms 46 depending upon a particular application, and that the rail 42 is only one example of a component that may fail and subsequently benefit from the guidance mechanism (s) 46.

Each guidance mechanism 46 may include a support structure 58, a retention device 60, and a guidance device 62. The retention device 60 may not generally be active (i.e., not making contact) during normal elevator car 30 operation. The guidance device 62 is generally active during normal elevator car operation facilitating guidance of the car along the lane 24. Like the retention device 60, the guidance device 62 may also serve to retain, or limit movement, of the elevator car 30 during a failure scenario.

The following description entails the guidance mechanism 46 associated or adjacent to the first lane structure 26; however, it is understood the guidance mechanism associated with the opposing lane structure 28 may generally be the same. The support structure 58 may include the rail 42 of the primary portion 32 that generally supports the coils 44. The support structure 58 may further include first and second projecting members 64, 66 that substantially project in opposite directions from one another and may be symmetrically located on respective sides of the linear propulsion motor 32. Each member 64, 66 may carry a respective retainer face 68, 70 that may be disposed between the elevator car 30 and the first lane structure 26, may substantially face the first lane structure, and may be spaced therefrom. The retention device 60 may include first and second sliders 72, 74 that generally oppose the respective first and second retainer faces 68, 70, and are disposed between the first lane structure 26 and the respective first and second retainer faces 68, 70. During normal elevator car 30 operation, the first and second sliders 72, 74 may be spaced from the respective first and second retainer faces 68, 70. During an operation derailment, as one example, the faces 68, 70 and respective sliders 72, 74 may make contact with one another thus preventing undesired movement of the elevator car 30 that may be a lateral movement of the elevator car away from the first lane structure 26 and toward the second lane structure 28.

The guidance device 62 may include first, second, third, and fourth rollers 76, 78, 80, 82 that may generally roll upon respective first, second, third and fourth guidance faces 84, 86, 88, 90 for, at least in-part, guidance of the elevator car 30 along the lane 24. The guidance faces 84, 88 may be carried by the first projecting member 64, and the guidance faces 86, 90 may be carried by the second projecting member 66. The first guidance face 84 and the second guidance face 86 may be carried by distal ends of the respective projecting members 64, 66, may face in substantially opposite directions to one-another, may both be disposed substantially normal to the retainer faces 68, 70, and may further be disposed substantially normal to the guidance faces 88, 90. The guidance faces 88, 90 may generally be disposed between the respective guidance faces 68, 70 and the elevator car 30, and may generally oppose the elevator car. The rollers 76, 78, 80, 82 may generally roll upon the respective faces 84, 86, 88, 90 during normal elevator car 30 operation, and may also facilitate retention of the elevator car during a failure scenario.

Figure 3:
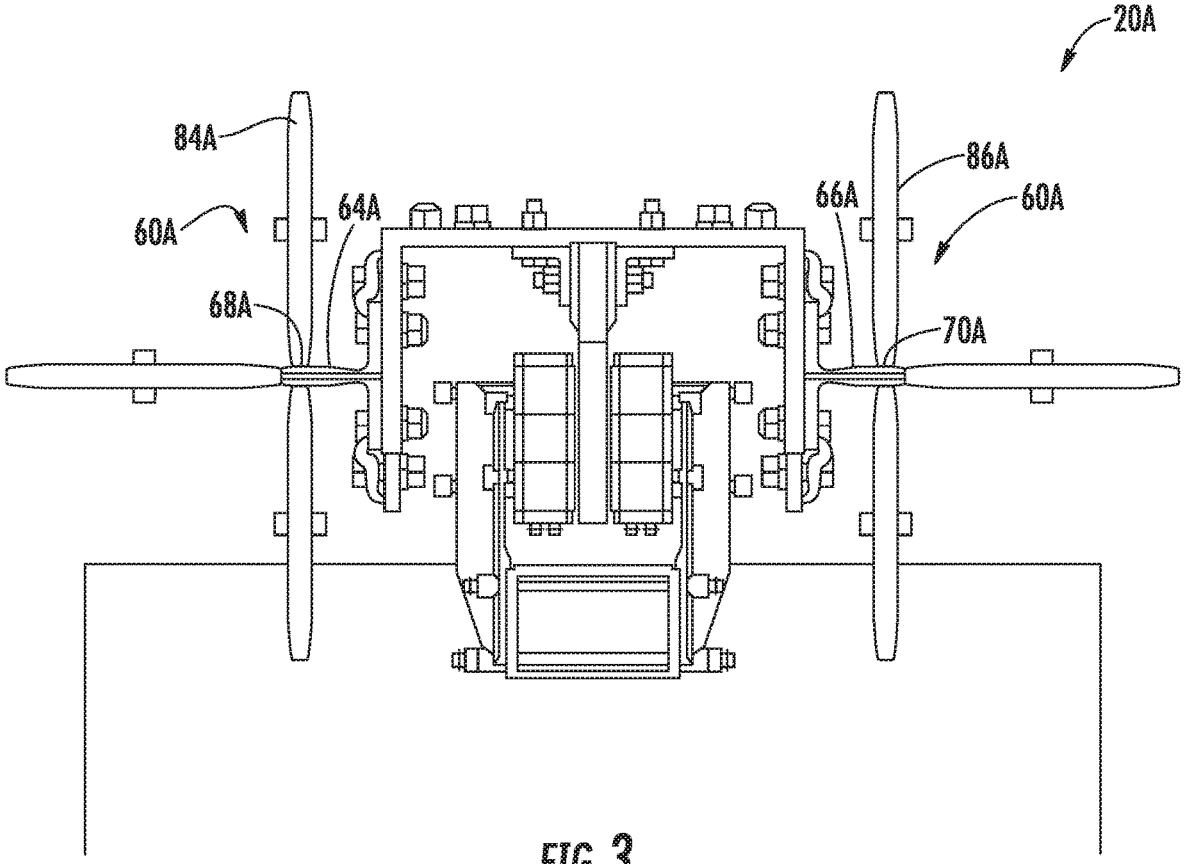
FIG. 3 is a top-down view of a second embodiment of a guidance mechanism.

Referring to FIG. 3, a second embodiment of an elevator system is illustrated wherein like elements have like identifying numerals except with the suffix of an "A." The elevator system 20A includes projecting members 64A, 66A each carrying respective retainer faces 68A, 70A. A retention device 60A may include retention rollers 84A, 86A that may be spaced from the retainer faces 68A, 70A during normal elevator car 30A operation and may roll upon the faces during a failure scenario. It is further contemplated and understood that the rollers 84A, 86A may alternatively roll upon the respective faces 68A, 70A to further guide the car 30A during normal operation.

Figure 4:
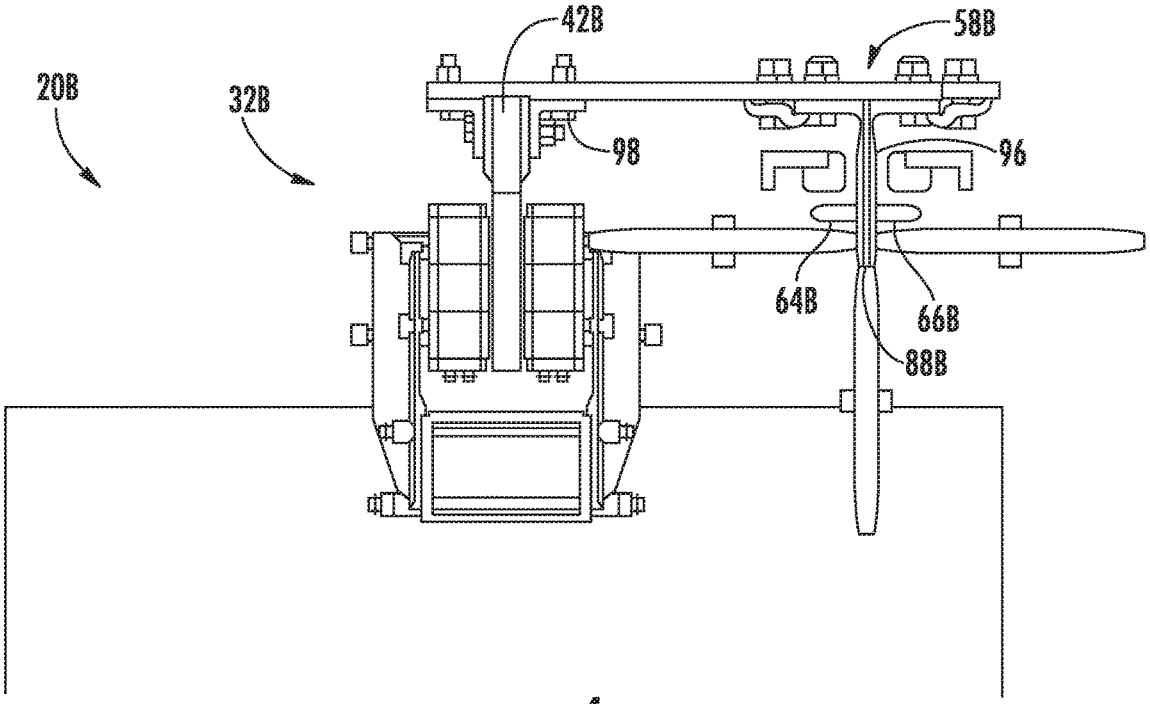
FIG. 4 is a top-down view of a third embodiment of a guidance mechanism.

Referring to FIG. 4, a third embodiment of an elevator system is illustrated wherein like elements have like identifying numerals except with the suffix of a "B." Unlike the first embodiment, an elevator system 20B of the second embodiment includes projecting members 64B, 66B that are both offset and spaced from one common side of a linear propulsion motor 32B. That is, they are not symmetrically located on respective sides of the linear propulsion motor 32B, and thus positioned independent of a rail bracket 98. A support structure 58B may include a stanchion 96 projecting outward from a lane structure 26B into a lane 24B. Projecting members 64B, 66B project outward in opposite directions from a mid-portion of the stanchion 96. A guidance face 88B may be carried by a distal end of the stanchion 96. The stanchion 96 combined with the projecting members 64B, 66B is generally cross-shaped in cross section.

Figure 5:
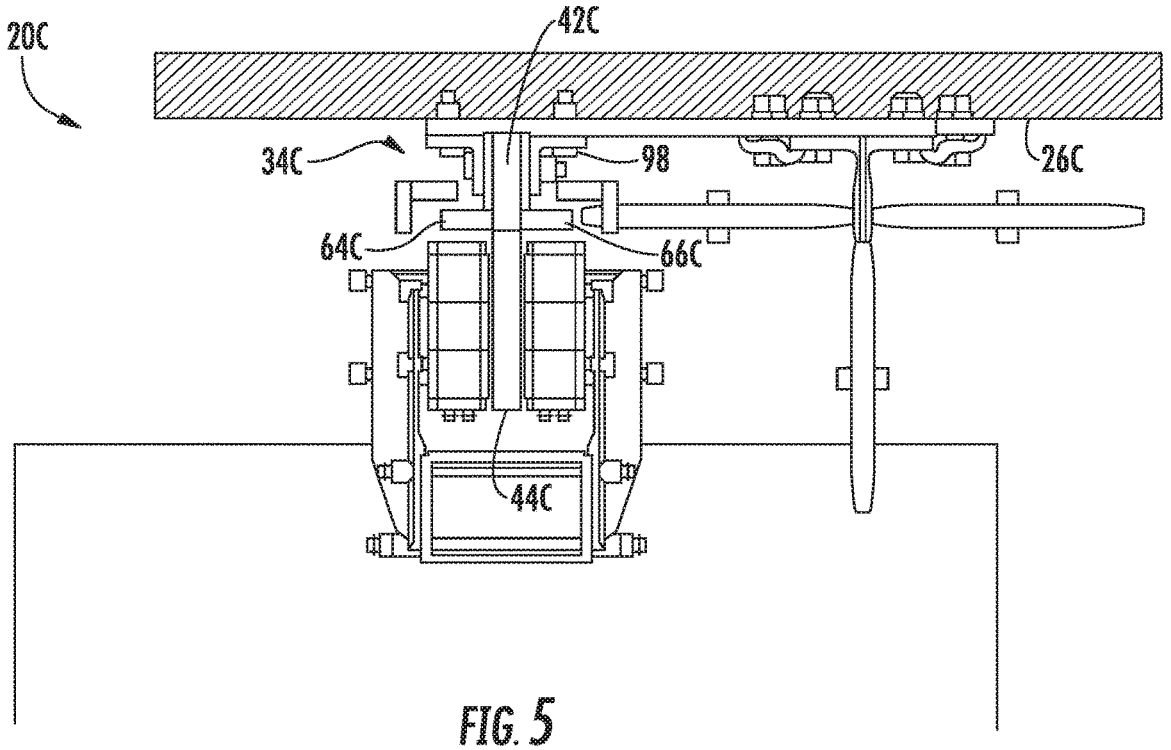
FIG. 5 is a top-down view of a fourth embodiment of a guidance mechanism.

Referring to FIG. 5, a fourth embodiment of an elevator system is illustrated wherein like elements have like identifying numerals except with the suffix of a "C". An elevator system 20C is similar to the third embodiment except that projecting members 64C, 66C project outward from either side of a rail 42 of a primary portion 34C secured to a lane structure 26C by a rail bracket 98C. The rail 42 directly supports a plurality of coils 44C of the linear propulsion motor 32C.

Figure 6:
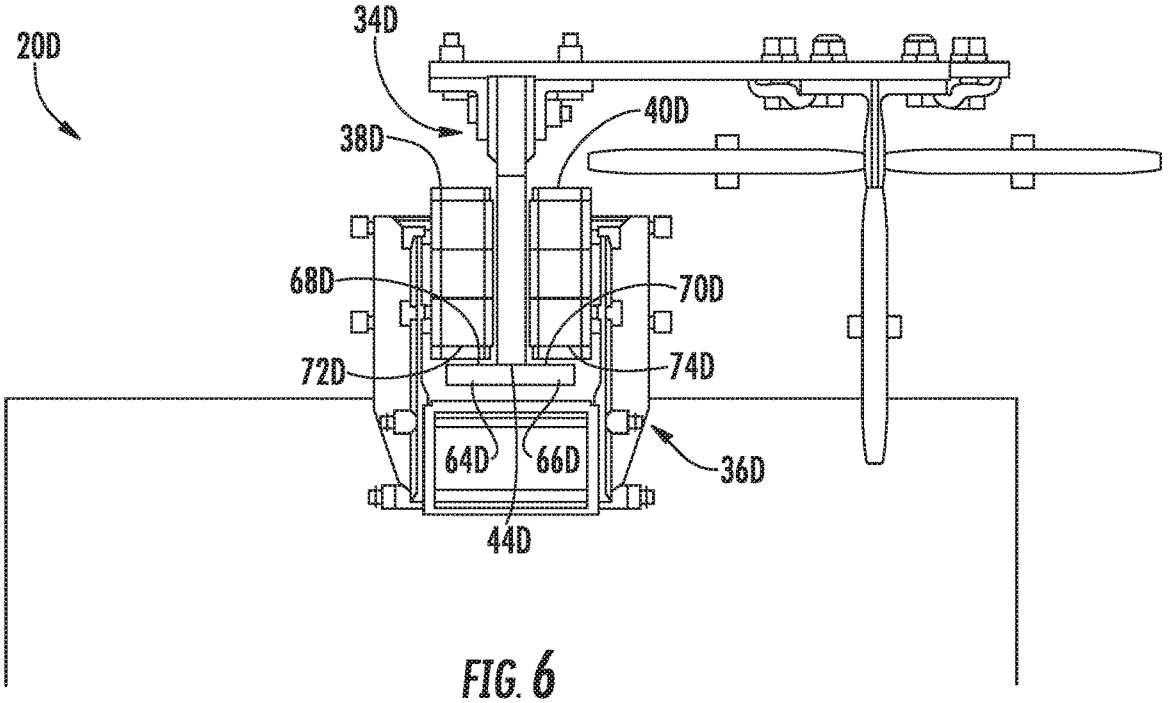
FIG. 6 is a top-down view of a fifth embodiment of a guidance mechanism.

Referring to FIG. 6, a fifth embodiment of an elevator system is illustrated wherein like elements have like identifying numerals except with the suffix of a "D". An elevator system 20D generally utilizes permanent magnets 38D, 40D of a secondary portion 36D as respective sliders 72D, 74D. Projecting members 64D, 66D project outward from a distal end of the plurality or row of coils 44D of the primary portion 34D with retainer faces 68D, 70D facing the respective magnets 38D, 40D.

Figure 7:
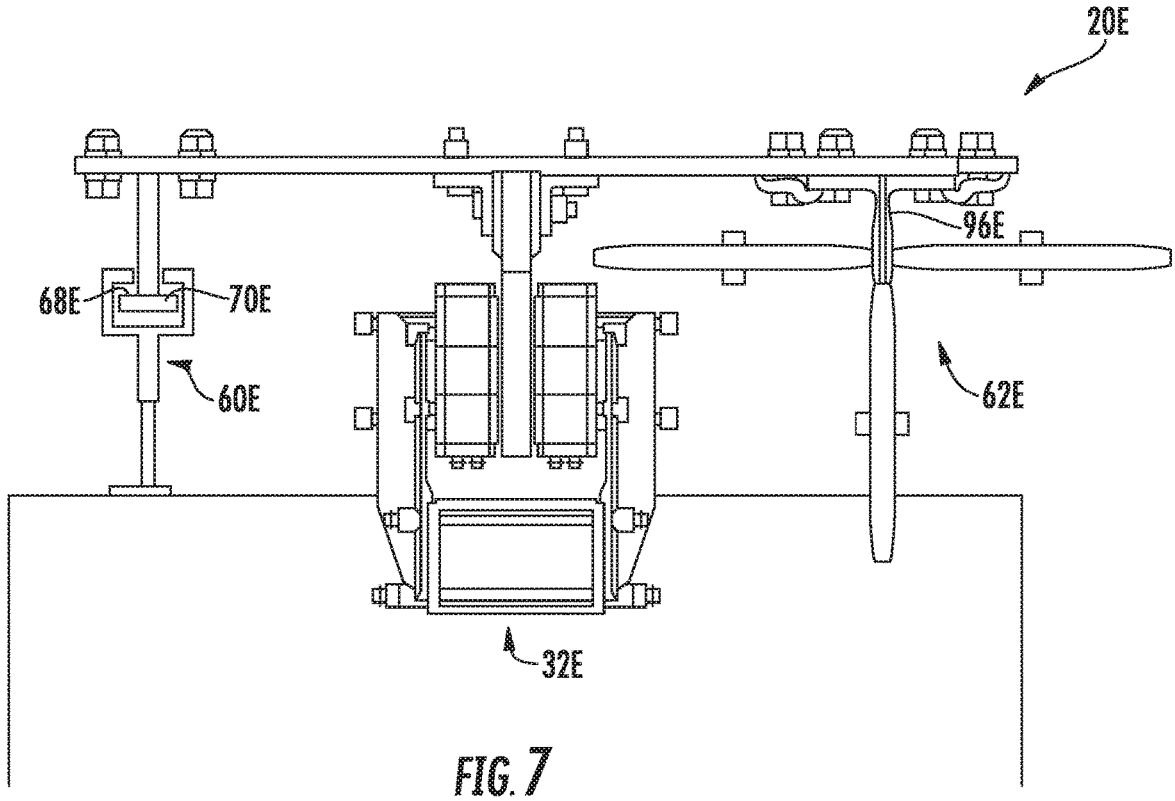
FIG. 7 is a top-down view of a sixth embodiment of a guidance mechanism.

Referring to FIG. 7, a sixth embodiment of an elevator system is illustrated wherein like elements have like identifying numerals except with the suffix of an "E". The elevator system 20E is similar to the fifth embodiment except that a retention device 60E and associated retainer faces 68E, 70E are separate from a stanchion 96E and associated guidance device 62E. Furthermore, a linear propulsion motor 32E may be spaced between the retention device 60E and the guidance device 62E.

Figure 8:
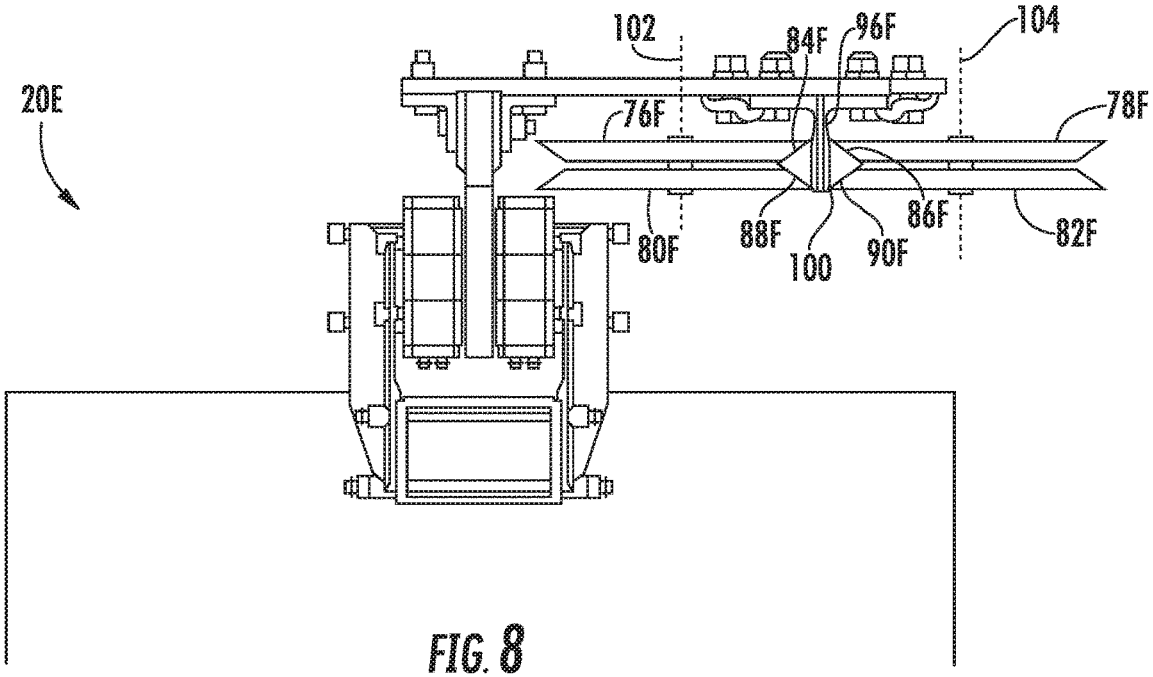
FIG. 8 is a top-down view of a seventh embodiment of a guidance mechanism.

Referring to FIG. 8, a seventh embodiment of an elevator system is illustrated wherein like elements have like identifying numerals except with the suffix of a "F". An elevator system 20E is similar to the third embodiment except that a stanchion 96F extends outward from a lane structure 26F and to an enlarged distal head 100 of the support structure 58F. The distal head 100 may be a parallelogram in cross-section and carries faces 84F, 86F, 88F, 90F that face away from one-another, and with faces 84F, 86F facing, in-part, toward a lane structure 26F and faces 88F, 90F facing, in-part, toward an elevator car 30F. Four rollers 76F, 78F, 80F, 82F roll upon the respective faces 84F, 86F, 88F, 90F thus functioning as both retention and guidance devices. The rollers 76F, 80F may share a common first rotational axis 102, and the rollers 78F, 82F may share a common second rotational axis 104 parallel to and spaced from the first rotational axis.

Figure 9:
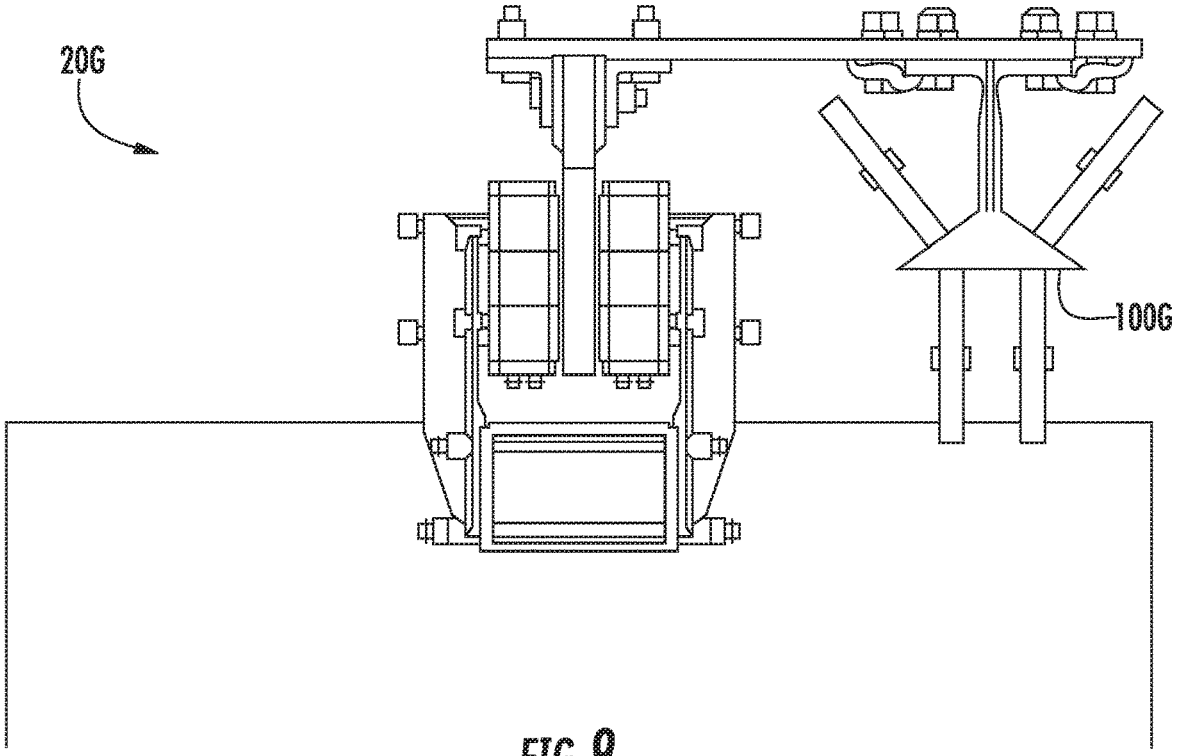
FIG. 9 is a top-down view of an eighth embodiment of a guidance mechanism.

Referring to FIG. 9, an eighth embodiment of an elevator system is illustrated wherein like elements have like identifying numerals except with the suffix of a "G". An elevator system 20G is similar to the seventh embodiment except that an enlarged distal head 100G is triangular in cross section.

Figure 10:
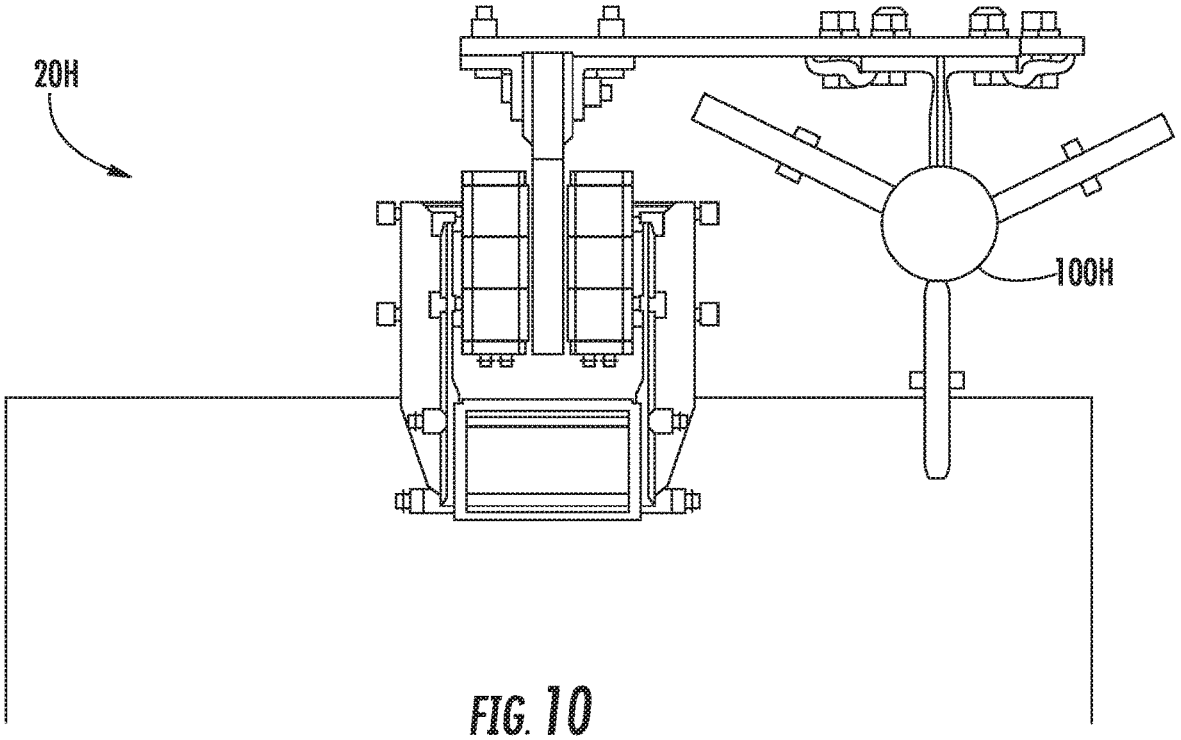
FIG. 10 is a top-down view of a ninth embodiment of a guidance mechanism.

Referring to FIG. 10, a ninth embodiment of an elevator system is illustrated wherein like elements have like identifying numerals except with the suffix of a "H". An elevator system 20H is similar to the seventh embodiment except that an enlarged distal head 100H is circular in cross section.

While the present disclosure is described with reference to exemplary embodiments, it will be understood by those skilled in the art that various changes may be made and equivalents may be substituted without departing from the spirit and scope of the present disclosure. In addition, various modifications may be applied to adapt the teachings of the present disclosure to particular situations, applications, and/or materials, without departing from the essential scope thereof. The present disclosure is thus not limited to the particular examples disclosed herein, but includes all embodiments falling within the scope of the appended claims.

What is claimed is:

1. A guidance mechanism for an elevator car constructed and arranged to move along a lane defined at least in-part between two opposing first and second lane structures of a stationary structure, the guidance mechanism comprising:

a first support structure supported by the first lane structure, the first support structure including a first retainer face disposed between the elevator car and the first lane structure, that substantially faces and is spaced from the first lane structure; and a first retention device disposed at least in part between the first retainer face and the first lane structure, supported by the elevator car, and constructed and arranged to contact the first retainer face for limiting lateral movement of the elevator car away from the first lane structure and toward the second lane structure, wherein the first retention device is a slider constructed and arranged to move along the first retainer face.

2. A guidance mechanism for an elevator car constructed and arranged to move along a lane defined at least in-part between two opposing first and second lane structures of a stationary structure, the guidance mechanism comprising:

a first support structure supported by the first lane structure, the first support structure including a first retainer face disposed between the elevator car and the first lane structure, that substantially faces and is spaced from the first lane structure;

a first retention device disposed at least in part between the first retainer face and the first lane structure, supported by the elevator car, and constructed and arranged to contact the first retainer face for limiting lateral movement of the elevator car away from the first lane structure and toward the second lane structure;

a first roller supported by the elevator car and constructed and arranged to roll upon a first guidance face of the first support structure, wherein the first guidance face faces substantially opposite the first retainer face;

a second roller supported by the elevator car and constructed and arranged to roll upon a second guidance face of the first support structure, wherein the second guidance face is disposed substantially normal to the first guidance face and the first retainer face; and a third roller supported by the elevator car and constructed and arranged to roll upon a third guidance face of the first support structure, wherein the third guidance face faces opposite the second guidance face.

3. The guidance mechanism set forth in claim 2, wherein the first support structure includes a rail bracket constructed and arranged to support at least a part of a first portion of a linear propulsion motor for propelling the elevator car.

4. The guidance mechanism set forth in claim 3 further comprising:

a second retainer face carried by a second projecting member of the first support structure disposed between the elevator car and the first lane structure, that substantially faces the first lane structure, and is spaced from the first lane structure, and wherein the first retainer face is carried by a first projecting member of the first support structure that projects in an opposite direction from the second projecting member; and a second retention device disposed at least in part between the second retainer face and the first lane structure, supported by the elevator car, and constructed and arranged to contact the second retainer face for limiting lateral movement of the elevator car away from the first lane structure and toward the second lane structure.

5. The guidance mechanism set forth in claim 4 further comprising:

a fourth roller supported by the elevator car and constructed and arranged to roll upon a fourth guidance face carried by the second projecting element and that faces opposite the second retainer face.

6. The guidance mechanism set forth in claim 5, wherein the first and second guidance faces are carried by the first projecting member and the third guidance face is carried by the second projecting member.

7. The guidance mechanism set forth in claim 2 further comprising:

a second retainer face carried by a second projecting member of the first support structure disposed between the elevator car and the first lane structure, that substantially faces the first lane structure, and is spaced from the first lane structure, and wherein the first retainer face is carried by a first projecting member of the first support structure that projects in an opposite direction from the second projecting member; and a second retention device disposed at least in part between the second retainer face and the first lane structure, supported by the elevator car, and constructed and arranged to contact the second retainer face for limiting lateral movement of the elevator car away from the first lane structure and toward the second lane structure.

* * * * *